US005219521A

United States Patent [19]

Adams et al.

[11] Patent Number: 5,219,521

[45] Date of Patent: Jun. 15, 1993

[54] ALPHA-BETA TITANIUM-BASE ALLOY AND METHOD FOR PROCESSING THEREOF

[75] Inventors: Roy E. Adams, Henderson; Warran M. Parris, Las Vegas; Paul J. Bania, Boulder City, all of Nev.

[73] Assignee: Titanium Metals Corporation, Denver, Colo.

[21] Appl. No.: 737,019

[22] Filed: Jul. 29, 1991

[51] Int. Cl.[5] ..... C22C 14/00

[52] U.S. Cl. ..... 420/418; 148/421; 148/669

[58] Field of Search ..... 420/418; 148/11.5 F, 148/421, 669

[56] References Cited

U.S. PATENT DOCUMENTS

| | | | |
|---|---|---|---|
| 2,666,698 | 1/1954 | Dickinson et al. | 420/418 |
| 2,798,806 | 7/1957 | Jaffee | 420/418 |
| 2,810,643 | 10/1957 | Methe | 420/418 |
| 4,299,626 | 11/1981 | Paton et al. | 420/418 |
| 4,871,400 | 10/1989 | Shindo et al. | 148/11.5 F |
| 4,886,559 | 12/1989 | Shindo | 148/11.5 F |

*Primary Examiner*—Upendra Roy

*Attorney, Agent, or Firm*—Finnegan, Henderson, Farabow, Garrett & Dunner

[57] ABSTRACT

An alpha-beta titanium-base alloy having a good combination of strength and ductility with a relatively low cost composition. The composition, in percent by weight, is 5.5 to 6.5 aluminum, 1.5 to 2.2 iron, 0.07 to 0.13 silicon and balance titanium. The alloy may have oxygen restricted in an amount up to 0.25%. The alloy may be hot-worked solely at a temperature above the beta transus temperature of the alloy to result in low T-M cost processing with improved product yields. The hot-working may include forging, which may be conducted at a temperature of 25° to 450° F. above the beta transus temperature of the alloy. The hot-working may also include hot-rolling, which also may be conducted at a temperature of 25° to 450° F. above the beta transus temperature of the alloy.

2 Claims, No Drawings

ALPHA-BETA TITANIUM-BASE ALLOY AND METHOD FOR PROCESSING THEREOF

BACKGROUND OF THE INVENTION

1. Field of the Invention

The invention relates to an alpha-beta titanium-base alloy having a good combination of strength and ductility, achieved with a relatively low-cost alloy composition. The invention further relates to a method for hot-working the alloy.

2. Description of the Prior Art

Titanium-base alloys have been widely used in aerospace applications, primarily because of their favorable strength to weight ratio at both ambient temperature and at moderately elevated temperatures up to about 1000° F. In this application, the higher cost of the titanium alloy compared to steel or other alloys is offset by the economic advantages resulting from the weight saving in the manufacture of aircraft. This relatively high cost of titanium-base alloys compared to other alloys has, however, severely limited the use of titanium-base alloys in applications where weight saving is not critical, such as the automobile industry. In automotive applications, however, utilization of titanium-base alloys would lead to increased fuel efficiency to correspondingly lower the operating cost of motor vehicles. In this regard, two conventional titanium-base alloys, namely Ti-6Al-4V and Ti-6Al-2Sn-4Zr-2Mo, have been used in automotive engines designed for racing cars with excellent results. Specifically, the former alloy has been used in these applications for connecting rods and intake valves, and the latter alloy has been used for exhaust valves. In these applications, however, efficiency and performance are of primary concern with material costs being secondary.

Some of the factors that result in the higher cost of titanium-base alloys, such as the cost of the base metal, cannot at present be substantially changed. Factors that are subject to beneficial change from the cost standpoint are the cost of the alloying elements. Specifically, with the conventional Ti-6Al-4V alloy, the vanadium adds significantly to the overall cost of the alloy. Specifically, at present vanadium (a beta stabilizer) costs approximately $13.50 per pound and thus adds about 50¢ per pound to the cost of the alloy. Consequently, if a less expensive beta stabilizing element could be used, such as iron, which costs about 50¢ per pound, this would add only about 2¢ per pound to the alloy if present in an amount equivalent to vanadium. In addition to the relatively high cost of vanadium, this is an element that is only obtainable from foreign sources.

Another factor that is significant in lowering the overall cost of titanium-base alloys is improved yield from ingot to final mill product. This may be achieved by improvements in mill processing, such as by reducing the energy and time requirements for mill processing or by an alloy composition that is more tolerant to current processing from the standpoint of material losses from surface and end cracking during mill processing, such as forging, rolling and the like. From the standpoint of increased yield from more efficient mill processing, an alloy composition that may be processed from ingot to final mill product at temperatures entirely within the beta-phase region of the alloy would provide increased yield because of the higher ductility and lower flow stresses existent at these temperatures. Consequently, processing could be achieved with less energy being used for the conversion operations, such as forging and hot-rolling. Currently, alpha-beta titanium-base alloys typically receive substantial hot-working at temperatures within their alpha-beta phase region. At these temperatures, during hot-working significant surface cracking and resulting higher conditioning losses result.

SUMMARY OF THE INVENTION

It is accordingly a primary object of the present invention to provide a titanium-base alloy having a combination of mechanical properties, namely strength and ductility, comparable to conventional alloys, including Ti-6Al-4V, at a relatively low cost alloy composition.

It is a further object of the present invention to provide an alloy of this character that can be hot-worked solely at temperatures above the beta transus temperature of the alloy to result in additional cost savings.

Broadly, in accordance with the invention, an alpha-beta titanium-base alloy is provided having a good combination of strength and ductility with a relatively low-cost alloy composition. The alloy consists essentially of, in weight percent, 5.5 to 6.5 aluminum, 1.5 to 2.2 iron, 0.07 or 0.08 to 0.13 silicon, and balance titanium. Optionally, the alloy may be restricted with regard to the oxygen content, with oxygen being present up to 0.25%. It has been determined that oxygen lowers the ductility of the alloy and thus is beneficially maintained with an upper limit of 0.25%. Particularly, oxygen contents in excess of 0.25% result in a significant adverse affect on ductility after creep exposure of the alloy of the invention.

DESCRIPTION OF THE PREFERRED EMBODIMENTS AND SPECIFIC EXAMPLES

A comparison of the alloy costs for the alloy of the invention compared to conventional Ti-5A1-4V using a nominal cost of $4.00 per pound for the titanium-base metal is shown in Table 1.

TABLE 1

Formulation Cost of Invention Alloy Compared to Ti-6Al-4V

| | Alloying Element | Cost/Lb[1] | % in Alloy | Cost in Alloy |
|---|---|---|---|---|
| Ti-6Al-4V | Al | $0.96 | 6.0 | $0.06 |
| | V | $13.69 | 4.0 | $0.55 |
| | Ti | $4.00 | 90.0 | $3.60 |
| | | | Total Cost/Lb | $4.21 |
| Ti-6Al-2F-0.1Si | Al | $0.96 | 6.0 | $0.06 |
| | Fe | $0.46 | 2.0 | $0.01 |
| | Si | $0.84 | 0.1 | $0.01 |
| | Ti | $4.00 | 91.9 | $3.68 |
| | | | Total Cost/Lb | $3.76 |

[1]Using approximate current commercial prices.

It may be seen from Table 1 that the invention alloy is 45¢ per pound, approximately 11%, less expensive from the composition standpoint than the conventional Ti-6A1-4V alloy based on current alloy costs.

TABLE 2

Tensile Properties of Preferred Invention Alloy Compared to Ti-6Al-4V

| Alloy[1] | Test Temp. F. | UTS ksi | YS ksi | % RA | % Elong |
|---|---|---|---|---|---|
| Ti-6.0Al-4.1V-.180$_2$ | 75 | 143.5 | 137.8 | 37.2 | 13.5 |
| | 300 | 124.6 | 115.3 | 53.0 | 16.5 |
| | 570 | 103.7 | 94.6 | 58.1 | 15.0 |
| | 900 | 94.4 | 80.9 | 60.4 | 18.5 |

TABLE 2-continued

Tensile Properties of Preferred Invention Alloy Compared to Ti-6Al-4V

| Alloy[1] | Test Temp. F. | UTS ksi | YS ksi | % RA | % Elong |
|---|---|---|---|---|---|
| Ti-5.8Al-1.9Fe-.09Si-.190$_2$ | 75 | 153.6 | 148.5 | 31.3 | 14.5 |
| | 300 | 137.8 | 121.5 | 36.0 | 15.0 |
| | 570 | 118.3 | 96.9 | 37.4 | 14.0 |
| | 900 | 95.9 | 81.6 | 63.9 | 23.0 |

[1]All material beta rolled to .5" dia + annealed 1300° F./2 hr/air cool

TABLE 3

Creep Properties of Preferred Invention Alloy Compared to Ti-6Al-4V

| Alloy[1] | Creep Rate,[2] % × 10−4 | Time to 0.2% Creep Hrs |
|---|---|---|
| Ti-6.0Al-4.1V-.180$_2$ | 5.06 | 100 |
| Ti-5.8Al-1.9Fe-.09Si-.190$_2$ | 1.39 | 331 |

[1]All material beta rolled to .5" dia. followed by anneal at 1300° F./2 hrs/air-cooled.
[2]Creep tested at 900 F.-12 ksi.

The tensile properties of an alloy in accordance with the invention compared to the conventional Ti-6Al-4V-180$_2$ alloy are presented in Table 2 and the creep properties of these two alloys at 900° F. are presented in Table 3. It may be seen that the alloy in accordance with the invention has a significantly higher tensile strength at approximately comparable ductility than the conventional alloy, along with higher creep strength at temperatures up to 900° F.

It has been additionally determined that the substitution of iron in the alloy of the invention, as opposed to the use of vanadium in the conventional alloy, improves the hot-workability of the alloy in amounts up to about 3%. This would result in higher product yields with regard to mill products produced from the alloy of the invention, as well as improved yields in final products, such as automotive valves, which require hot-working incident to the manufacture thereof.

TABLE 4

Nominal Compositions and Chemical Analyses of the First Alloy Group Tested

| Nominal Composition | Al | V | Fe | Cr | Si | O | N |
|---|---|---|---|---|---|---|---|
| Ti-6Al-4V | 5.96 | 4.10 | 0.055 | | | 0.18 | 0.002 |
| Ti-3Al-1.5Cr-1.5Fe | 2.92 | | 1.50 | 1.47 | | 0.18 | 0.003 |
| Ti-6Al-2Fe | 5.68 | | 2.17 | | | 0.193 | 0.001 |
| Ti-6Al-2Fe-0.1Si | 5.80 | | 1.99 | | 0.087 | 0.198 | 0.002 |
| Ti-6Al-2Fe-0.02Y | 5.69 | | 2.00 | | | 0.189 | 0.002 |
| Ti-6Al-1Fe-1Cr | 5.44 | | 1.13 | 1.05 | | 0.222 | 0.001 |
| Ti-8Al-2Fe | 7.46 | | 2.06 | | | 0.206 | 0.001 |

By way of demonstration of the invention, seven alloy compositions were produced. These compositions includes as a control alloy the conventional Ti-6A1-4V alloy. The alloys were produced by double vacuum arc melting (VAR) to provide 75 pound ingots. The ingots had the nominal compositions set forth in Table 4. These ingots were converted to 0.5-inch diameter bar by a combination of hot-forging followed by hot-rolling. Portions of each ingot were solely processed at temperatures within the beta-phase region of the alloy.

TABLE 5

Tensile Properties of First Group of Alloys[1]

| Alloy Nominal Composition | Test Temp, F. | UTS ksi | YS ksi | % RA | % Elong |
|---|---|---|---|---|---|
| Ti-6Al-4V | 75 | 143.5 | 137.8 | 37.2 | 13.5 |
| | 300 | 124.6 | 115.3 | 53.0 | 16.5 |
| | 570 | 103.7 | 94.6 | 58.1 | 15.0 |
| | 900 | 94.4 | 80.9 | 60.4 | 18.5 |
| Ti-3Al-1.5Cr-1.5Fe | 75 | 125.2 | 115.0 | 41.5 | 17.5 |
| | 300 | 107.9 | 90.7 | 54.6 | 23.0 |
| | 570 | 88.5 | 69.5 | 64.0 | 21.0 |
| | 900 | 71.2 | 59.0 | 83.0 | 27.0 |
| Ti-6Al-2Fe | 75 | 151.8 | 143.6 | 30.6 | 15.5 |
| | 300 | 133.7 | 118.2 | 39.9 | 15.0 |
| | 570 | 115.0 | 93.3 | 39.7 | 15.0 |
| | 900 | 94.2 | 79.4 | 63.7 | 21.0 |
| Ti-6Al-2Fe-0.1Si | 75 | 153.6 | 148.5 | 31.3 | 14.5 |
| | 300 | 137.8 | 121.5 | 36.0 | 15.0 |
| | 570 | 118.3 | 96.9 | 37.4 | 14.0 |
| | 900 | 95.9 | 81.6 | 63.9 | 23.0 |
| Ti-6Al-2Fe-0.02Y | 75 | 147.8 | 143.2 | 31.1 | 15.0 |
| | 300 | 130.7 | 114.7 | 38.1 | 15.5 |
| | 570 | 112.4 | 90.8 | 46.8 | 15.5 |
| | 900 | 93.4 | 81.1 | 66.2 | 21.0 |
| Ti-6Al-1Fe-1Cr | 75 | 147.3 | 140.5 | 29.1 | 14.5 |
| | 300 | 131.6 | 115.0 | 38.9 | 15 |
| | 570 | 111.5 | 92.3 | 40.0 | 14.5 |
| | 900 | 97.9 | 82.1 | 57.7 | 18.5 |
| Ti-8Al-2Fe | 75 | 168.8 | 162.5 | 5.8 | 4.0 |
| | 300 | 155.6 | 141.1 | 10.6 | 5.0 |
| | 570 | 141.0 | 118.4 | 28.3 | 13.5 |
| | 900 | 117.0 | 99.7 | 42.8 | 19.5 |

[1]0.5 inch dia. bar beta rolled and annealed at 1300 F. (2 hrs) AC

The tensile properties at temperatures from ambient to 900° F. of the alloys of Table 4 processed by hot-working within the beta-phase region thereof followed by annealing are presented in Table 5. As may be seen from the data presented in Table 5, all of the three Ti-6A1-2Fe-base alloys had strengths higher than the control Ti-6A1-2Fe base alloys had strengths higher than the control Ti-6A1-4V alloy. The ductilities of these alloys in accordance with the invention were comparable to the control alloy and they exhibited an excellent combination of strength and ductility. The alloy containing 0.02% yttrium was provided to determine whether it would result in improving the ductility of this beta processed alloy. The data in Table 5 indicate that yttrium had little or no affect on the ductility of the base Ti-6AlFe alloy. The addition of 0.1% silicon to the base Ti-6AlFe alloy resulted in an improvement in the creep properties of the alloy, as shown in Table 6.

TABLE 6

Effect of 0.1% Silicon on the Creep Properties[1] of Ti-6Al-2Fe

| Alloy[2] | Creep Rate, % × 10−4 | Time to 0.2% Creep, Hrs |
|---|---|---|
| Ti-6Al-2Fe | 1.72 | 172 |
| Ti-6Al-2Fe-0.1Si | 1.39 | 331 |

[1]Creep tested at 900 F. - 12 ksi.
[2]Material from Tables 4 and 5.

Table 5 also substantiates the following Conclusions:

a) Low aluminum (about 3%) results in strengths well below the benchmark Ti-6Al-4V alloy.
b) High aluminum (about 8%) results in a substantial penalty in ductility.
c) While Cr can be substituted for Fe in terms of strengthening, there is no justification in terms of properties for using the higher cost Cr vs. Fe.

Considering the results in Tables 4 thru 6, it was concluded that an alloy based on the Ti-6Al-2Fe-.1Si composition would meet the desired mechanical property and strength goals. The acceptable limits of the alloying elements were then assessed. The aluminum level of 6% (nominal) appeared optimum, based on the indication of poor strength at low aluminum levels and poor ductility at higher levels (Table 5). Silicon was also believed to be optimized at 0.1%, since higher levels result in melting difficulties and thus higher cost. Thus, iron and oxygen were selected for further study.

The chemistries melted and processed for iron and oxygen effects are listed in Table 7. The iron ranged from 1.4 to 2.4% and the oxygen ranged from 0.17 to 0.25%.

TABLE 7

Alloys Melted and Processed to Study Iron and Oxygen Effects in Ti-6Al-XFe-.1Si-$XO_2$ Base

| Alloy | Al | Fe | Si | $O_2$ |
|---|---|---|---|---|
| A | 6.1 | 2.4 | .09 | .25 |
| B | 6.1 | 2.0 | .09 | .24 |
| C | 6.3 | 1.4 | .09 | .24 |
| D | 6.2 | 2.3 | .09 | .18 |
| E | 6.2 | 1.9 | .10 | .17 |
| F | 6.2 | 1.4 | .09 | .17 |

The alloys listed in Table 7 were beta processed (forged and rolled above the beta transus temperature) to 0.5 in. dia. rod and subsequently heat treated by three processes per alloy as follows:

Heat Treat Process 1

Solution treated for 1 hour at 100° F. below the beta transus temperature followed by water quenching and aging at 1000° F./8 hrs.

Heat Treat Process 2

Annealed 1300° F. for two hours.

Heat Treat Process 3

Annealed 1450° F. for two hours.

TABLE 8

Mechanical Properties[1] of Table 7 Alloys
Material Condition: Beta Rolled/Air Cooled + Solution Treated β-100° F./WO + 1000/8/AC Age

| Alloy[2] | | | Room Temp Tensile | | 900° F. Tensile | | Creep (Hrs to | Post Creep Tensile | |
|---|---|---|---|---|---|---|---|---|---|
| Al | Fe | $O_2$ | YS | % RA | YS | % RA | .2%) | YS | % RA |
| 6.1 | 2.4 | .25 | 171 | 7 | 92 | 70 | 500 | — | 0 |
| 6.1 | 2.0 | .24 | 153 | 19 | 86 | 56 | 740 | 157 | 9 |
| 6.3 | 1.4 | .24 | 151 | 17 | 83 | 52 | 500 | 152 | 8 |
| 6.2 | 2.3 | .18 | 162 | 8 | 88 | 71 | 330 | 165 | 6 |
| 6.1 | 1.9 | .17 | 146 | 19 | 84 | 72 | 780 | 146 | 18 |
| 6.1 | 1.4 | .17 | 142 | 24 | 78 | 57 | 690 | 145 | 17 |

[1]YS = Yield Strength (ksi); % RA = % Reduction in Area; Creep test run at 900° F./12 ksi.
[2]All alloys contain nominally .09 to .10 Si.

TABLE 9

Mechanical Properties[1] of Table 7 Alloys
Material Condition: Beta Rolled + Annealed 1300° F./2 Hrs/Air Cooled

| Alloy[1] | | | RT Tensile | | 900° F. Tensile | | Creep[2] Time to .2% | Post Creep Tensile | |
|---|---|---|---|---|---|---|---|---|---|
| Al | Fe | $O_2$ | YS | % RA | YS | % RA | Hrs | YS | % RA |
| 6.1 | 2.4 | .25 | 159 | 26 | 86 | 73 | 25 | Broke Before Yield | |
| 6.1 | 2.0 | .24 | 153 | 30 | 83 | 71 | 13 | 154 | 9 |
| 6.3 | 1.4 | .24 | 152 | 32 | 80 | 64 | 22 | 151 | 12 |
| 6.2 | 2.3 | .18 | 152 | 26 | 84 | 70 | 12 | 149 | 8 |
| 6.1 | 1.9 | .17 | 147 | 33 | 87 | 68 | 17 | 148 | 5 |
| 6.1 | 1.4 | .17 | 142 | 29 | 78 | 66 | 26 | 143 | 16 |

[1]YS = Yield Strength (ksi); % RA = % Reduction in Area; Creep test run at 900° F./12 ksi.
[2]Material from Tables 4 and 5.

TABLE 10

Mechanical Properties[1] of Table 7 Alloys
Material Condition: Beta Rolled + Annealed 1450° F./2 Hrs/Air Cooled

| Alloy[1] | | | RT Tensile | | 900° F. Tensile | | Creep[2] Time to .2% | Post Creep Tensile | |
|---|---|---|---|---|---|---|---|---|---|
| Al | Fe | $O_2$ | YS | % RA | YS | % RA | Hrs | YS | % RA |
| 6.1 | 2.4 | .25 | 155 | 25 | 84 | 71 | 70 | 156 | 3 |
| 6.1 | 2.0 | .24 | 150 | 33 | 80 | 67 | 46 | 154 | 11 |
| 6.3 | 1.4 | .24 | 150 | 34 | 79 | 65 | 83 | 152 | 10 |
| 6.2 | 2.3 | .18 | 142 | 38 | 82 | 70 | 24 | 147 | 30 |
| 6.1 | 1.9 | .17 | 144 | 34 | 80 | 69 | 38 | 147 | 13 |
| 6.1 | 1.4 | .17 | 140 | 39 | 73 | 67 | 81 | 142 | 22 |

[1]YS = Yield Strength (ksi); % RA = % Reduction in Area; Creep test run at 900° F./12 ksi.
[2]All alloys contain nominally .09 to .10 Si.

Tables 8, 9 and 10 summarize the mechanical properties obtained from these alloys in the three heat treat conditions. It is clear that for all three conditions, the high iron level (2.4%) at a high oxygen level results in unacceptably low post-creep ductility. Since certain cost considerations, such as scrap recycle, dictate as high an oxygen level as possible, this suggests that iron should be kept below the 2.5% limit. Since strength, particularly at 900° F., noticeably drops off as iron is reduced to about 1.4%, this indicates a rather narrow range of iron content in order to provide adequate properties. Considering normal melting tolerances, the acceptable iron range is 1.5 to 2.2%.

Tables 8 thru 10 also indicate that oxygen levels up to 0.25% are acceptable, provided iron is kept below about 2.4%.

We claim:

1. An alpha-beta titanium-base alloy having a good combination of strength, creep resistance and ductility with a relative low-cost alloy composition, said alloy consisting essentially of, in weight percent, 5.5 to 6.5 aluminum, 1.5 to 2.2% iron, 0.07 to 0.13 silicon, and balance titanium and incidental impurities in amounts not materially affecting the properties of the alloy.

2. The alloy of claim 1 having up to 0.25% oxygen.

* * * * *